United States Patent [19]

Trematerra

[11] Patent Number: 5,070,892

[45] Date of Patent: Dec. 10, 1991

[54] ARTIFICIAL NAIL TIP HAVING TRIMMABLE SIZING GUIDE

[76] Inventor: Irene Trematerra, 825 Parkside Cir. North, Boca Raton, Fla. 33486

[21] Appl. No.: 600,588

[22] Filed: Oct. 18, 1990

[51] Int. Cl.[5] ..... A45D 29/00

[52] U.S. Cl. ..... 132/73

[58] Field of Search ..... 132/73, 73.5, 285, 333

[56] References Cited

U.S. PATENT DOCUMENTS

| | | | |
|---|---|---|---|
| 1,238,046 | 8/1917 | Nuss | 132/73 X |
| 2,013,290 | 9/1935 | Rohrbach | 132/73 X |
| 3,750,684 | 8/1973 | Russell | 132/73 |
| 4,596,260 | 6/1986 | Giuliano | 132/73 |
| 4,625,740 | 12/1986 | Roth | 132/73 |
| 4,805,645 | 2/1989 | Schiff et al. | 132/73 |
| 4,960,138 | 10/1990 | Kling | 132/73 |

*Primary Examiner*—John J. Wilson
*Assistant Examiner*—Jeffrey A. Smith
*Attorney, Agent, or Firm*—Malin, Haley, McHale, Dimaggio & Crosby

[57] ABSTRACT

An artificial nail tip having cosmetic and/or prosthetic applications, which includes a recessed rear portion with a predisposed edge pattern which facilitates more efficient and effective attachment to both normal and problem nails. A stair-step, sawtooth or other useful pattern is cut into the edges of the predisposed edge for use as an accurate guide in length for quick and symmetrical trimming of excess material from the rear portion of the artificial nail during fitting and attachment. The edge pattern also increases the area with which a suitable adhesive comes into contact and thereby increases the strength of the bond to a natural nail.

4 Claims, 1 Drawing Sheet

ARTIFICIAL NAIL TIP HAVING TRIMMABLE SIZING GUIDE

BACKGROUND OF THE INVENTION

1. Field of the Invention

The present invention relates to an artificial nail tip with improvements over the prior art which allow for more efficient and effective attachment to a natural nail for prosthetic and/or cosmetic purposes.

2. Description of the Prior Art

Cosmetic and/or prosthetic nail tips have long been known in the art. In the past, cosmetologists have trimmed various parts of the artificial nail tip away in order to both better fit the artificial nail tip to the bonding surface and also provide greater flexibility in the bonded section of the nail tip for a more secure attachment.

Various U.S. patents of possible interest and relevance to the present invention include the following: U.S. Pat. No. 2,764,166; U.S. Pat. No. 2,864,384; U.S. Pat. No. 3,478,756; U.S. Pat. No. 3,982,551; U.S. Pat. No. 4,211,246; and U.S. Pat. No. 4,346,720.

Schiff et al., U.S. Pat. No. 4,805,645, goes so far as to disclose an artificial nail including a perforated, and thus removeable, rear section which accomplishes the task of cutting required to increase flexibility of the overlay portion for a more proper attachment to an irregular or problem nail surface. The perforations, however, may or may not leave a regular pattern, perhaps would leave no pattern at all after the unneeded piece is removed. Remnants of the perforation may even become a hindrance needing to be filed or cut away if there is not a clean break between the usable and discarded portions. No provision is made for accurately and symmetrically trimming the artificial nail tip to fit an individual recipient.

Further disclosed in the prior art is a rear or overlay portion thinner than the forward portion of the nail tip providing further increase in flexibility. Even or symmetrical measurement in length for accurate fitting and additional trimming, when necessary, remains, however, difficult.

None of these references discloses an artificial nail tip both readily attachable to regular and irregular nail surfaces and also having a predisposed pattern useful for measurements in trimming and improvement of adhesion to an intended surface as is disclosed by the present invention.

SUMMARY OF THE INVENTION

The present invention discloses an artificial nail tip possessing a rear or overlay portion, pre-cut into an arch, "V", or other suitable shape providing greater flexibility in that portion of the artificial nail tip for ease of attachment to variously curved and/or irregularly shaped natural nail surfaces. The artificial nail tip provides, cut into the edges of this rear portion, a stair-step, sawtooth or other suitable pattern having segments of equal dimension usable as a guide for quick, symmetrical trimming of excess material from the artificial nail tip during fitting and attachment. The steps or notches of this guide pattern are sized in a predetermined known length and are spaced a known distance from each other on both sides of the rear edge which allows for quick sight measurements simply by counting the number of steps or notches to be either saved or trimmed away. The pattern affords the added benefit of increasing the distance and area of the surface which will come into contact with a suitable adhesive during bonding. This strengthens the bond to the natural nail and improves the utility of the artificial nail tip.

It is therefore an object of the present invention to provide an artificial nail tip more efficiently and effectively attachable to natural nails of any regular or irregular contour or surface condition.

A more specific object of the present invention is to provide an artificial nail tip which is pre-cut to include a suitable shape and design to facilitate increased flexibility and precision in individual fitting and also increased strength in the bonding region.

In accordance with these and other objects which will be apparent hereinafter, the instant invention will now be described with particular reference to the accompanying drawings.

DESCRIPTION OF THE PREFERRED EMBODIMENT

Figure 1:
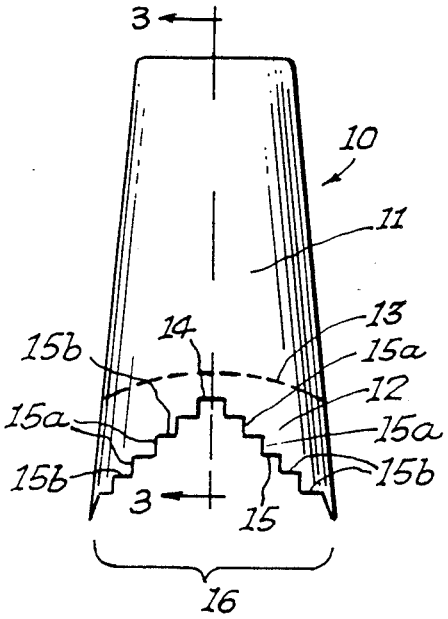
FIG. 1 is a top plan view of the present invention showing the cut away section of the overlay portion of the nail tip, including the distinctive edge pattern.
Figure 3:
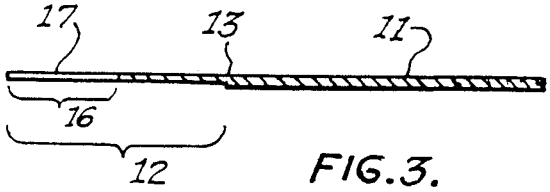
FIG. 3 is a cross-sectional view taken along the line 3—3 indicated in FIG. 1 showing the difference in thickness between the forward nail portion and the rear or overlay portion.
Figure 2:
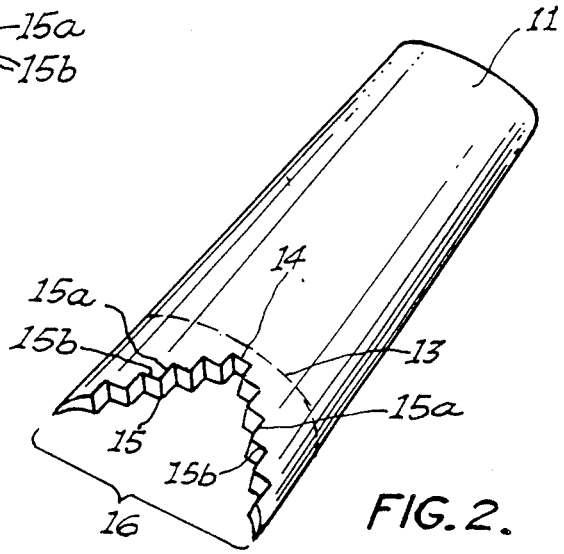
FIG. 2 is a perspective view of the present invention illustrating the three dimensional nature of the invention and again showing the novel use of an edge pattern within the cutaway area.

Referring now to FIGS. 1 through 3, the artificial nail tip 10 made of any suitable material is comprised of a forward section 11 distinguished by dotted line 13 from a rear or overlay portion 12 having less thickness than the forward section 11. The difference in thickness is caused by the layering of additional material onto the forward section 11 during the manufacturing process. A distinct border 13 between the forward and overlay sections exists on the underside of the artificial nail tip. Behind this border 13 is meant to rest the natural nail surface to which the artificial nail tip is being bonded.

Center position 14 represents the center of a cut out portion at the rear of the overlay 12 to illustrate the basic shape of the cutaway section 16. Further, the inner edges of the cutaway section 16 have cut into them a stair-step, sawtooth, or other useful pattern 15. The pattern 15 is of a symmetrical design and having known distances between each step or notch which allow for fast and symmetrical measurement in length and trimming of excess material when necessary for a more effective fit to a natural nail. The longitudinal segments **15*a* are of equal length and are parallel. The lateral segments 15*b* are symmetrically paired, equal in length, and laterally aligned. The flexibility afforded by the relative thinness of the overlay 12 and the shape of the cutaway section 16 allows for a more secure bond between a natural nail plate and the artificial nail tip 10** as a result of greater contact between the bonded surfaces.

As an example of use of the present invention, cosmetologists would fit the artificial nail tip precisely to the recipient's nail by trimming segments on each side symmetrically of a known length. For example, if each of the pattern 15 longitudinal and lateral segments were $\frac{1}{8}$ inches, and the artificial nail tip need to be trimmed $\frac{1}{4}$ inches along each side, the operator would then cut the segments (two on each side) so that a reduction in length of the standard artificial nail tip would be achieved of $\frac{1}{4}$ inches. With the predetermined segment lengths of the pattern, great accuracy and speed can be achieved in the trimming and fitting of the artificial nail tip using the pattern as provided symmetrically.

Further, the pattern 15, by its very nature, increases the area along the face 17 of the cutaway section relative to the area attainable by a straight or curved cut away line. This pattern 15 increases the area when compared with a conventional artificial nail tip with which a suitable adhesive will come into contact during bonding and thus affords a stronger bond than previous designs allow.

Figure 4:
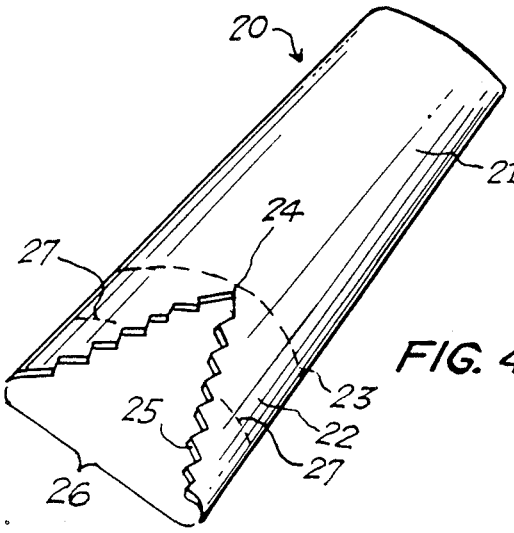
FIG. 4 is a perspective view of an alternate embodiment of the invention.

FIG. 4 shows an alternate embodiment of the invention in which the artificial nail tip 20, again made of a suitable material, is comprised of a forward section 21 distinguished by dotted line 23 from the overlay portion 22 having less thickness than the forward section 21 similar to the previous embodiment shown. The major difference between the artificial nail tip 20 shown in FIG. 4 and the one previously described in FIGS. 1 through 3, commencing at the center portion 24, is the angle of segments 25 relative to the centerline longitudinal axis of the entire nail. In particular, dotted lines 27 represent the continuation of segments 25 from an inward position toward the outside lateral edge of the artificial nail tip. Note that each segment edge forms an acute angle relative to a longitudinal center line of approximately 45 degrees relative to the center longitudinal axis when measured from the overlay end to the segment edge. In the embodiment shown in FIG. 2, segment edges are essentially perpendicular or parallel to the longitudinal center line axis. By providing the acute angular provisions shown in FIG. 4 as represented by dotted lines 27, a cut extending along a linear direction from the segment will be symmetrical on both sides of the nail tip providing identical lengths at each of the lateral edges of the artificial nail tip. In this embodiment after each segment is cut on each side, more surface area of overlay will remain (compared with the lateral cuts described in FIGS. 1-3). Thus each of the segments 25 are identical in length relative to the corresponding segment on the opposite side of the overlay cutaway section 26 and provide a guide so that cutting a line extending from each segment will produce a balanced symmetrical cut and allow extension of the nail tip body along the lateral edges on each side for the cut. The additional area will provide increased strength and still allow for precise cutting by the operator.

The present invention has shown an artificial nail tip that can provide a rear cutaway portion having a unique pattern so that segments can be symmetrically cut on each side of a predetermined length so that the nail will fit correctly and symmetrically upon the recipient's actual nail. Use of the present invention greatly increases the speed and accuracy of attachment of the artificial nail tip and the bonding achieved.

The instant invention has been shown and described herein in what it is considered to be the most practical and preferred embodiment. It is recognized, however, that departures may be made therefrom within the scope of the invention and that obvious modifications will occur to a person skilled in the art.

What I claim is:

1. An artificial nail tip comprising:

a preformed artificial nail having a forward section of a given thickness and a rear section of a reduced thickness when compared with the forward section, the rear section forming an overlay portion of the artificial nail tip, said rear section having a recessed area defined by a rear edge, said rear edge having a predetermined pattern of individual segments each of which is of an equal predetermined length in the longitudinal direction of the artificial nail tip;

said rear edge overlay pattern is formed as a stair step pattern.

2. An artificial nail tip comprising:

a performed artificial nail having a forward section of a given thickness and a rear section of a reduced thickness when compared with the forward section, the rear section forming an overlay portion of the artificial nail tip, said rear section having a recessed area defined by a rear edge, said rear edge having a predetermined pattern of individual segments each of which is of an equal predetermined length in the longitudinal direction of the artificial nail tip;

said rear edge pattern being a sawtooth pattern.

3. An artificial nail tip comprising:

a thin body shaped as an actual human fingernail including a longitudinal center line, a first portion for extending beyond and overhanging the actual nail of a recipient and a rear portion for attachment to the actual nail of a recipient, said thin body rear portion having a recessed area defined by an edge symmetrically disposed about the longitudinal center line of the thin body, said rear portion recessed area having a means for providing indicia for accurately measuring predetermined linear segments along the rear portion recessed area edge relative to the longitudinal center line of the artificial nail tip so that the indicia can be used as a trimming and cutting guide for determining an accurate length for proper fitting of a recipient, said means providing indicia for trimming said artificial nail accurately in length includes a stair step pattern in which the longitudinally disposed segments are of equal length and are symmetrical about said center line of the thin body.

4. An artificial nail tip as in claim 3, wherein:

each of said predetermined linear segments are disposed at approximately a 45 degree angle to the longitudinal center line of said artificial nail tip.

* * * * *